US010535299B2

(12) United States Patent
Ling et al.

(10) Patent No.: US 10,535,299 B2
(45) Date of Patent: Jan. 14, 2020

(54) PIXEL CIRCUIT, ARRAY SUBSTRATE, DISPLAY DEVICE AND PIXEL DRIVING METHOD

(71) Applicants: BOE Technology Group Co., LTD., Beijing (CN); Hefei BOE Optoelectronics Technology Co., LTD., Hefei, Anhui (CN)

(72) Inventors: Jie Ling, Beijing (CN); Wenjian Wang, Beijing (CN); Wei Lei, Beijing (CN)

(73) Assignees: BOE TECHNOLOGY GROUP CO., LTD., Beijing (CN); HEFEI BOE OPTOELECTRONICS TECHNOLOGY CO., LTD., Anhui (CN)

( * ) Notice: Subject to any disclaimer, the term of this patent is extended or adjusted under 35 U.S.C. 154(b) by 0 days.

(21) Appl. No.: 16/196,109

(22) Filed: Nov. 20, 2018

(65) Prior Publication Data

US 2019/0295463 A1 Sep. 26, 2019

(30) Foreign Application Priority Data

Mar. 22, 2018 (CN) ..... 2018 1 0239996

(51) Int. Cl.
*G09G 3/3225* (2016.01)

(52) U.S. Cl.
CPC ... *G09G 3/3225* (2013.01); *G09G 2300/0819* (2013.01); *G09G 2310/0251* (2013.01); *G09G 2310/061* (2013.01)

(58) Field of Classification Search
CPC ..... G09G 3/3225; G09G 2300/0819; G09G 2310/0251; G09G 2310/061
See application file for complete search history.

(56) References Cited

U.S. PATENT DOCUMENTS

2009/0219232 A1* 9/2009 Choi ..... G09G 3/3233 345/76
2009/0309816 A1* 12/2009 Choi ..... G09G 3/3233 345/76
2011/0102403 A1* 5/2011 Kim ..... G09G 3/3233 345/211

(Continued)

*Primary Examiner* — Roberto W Flores
(74) *Attorney, Agent, or Firm* — Nath, Goldberg & Meyer; Joshua B. Goldberg

(57) ABSTRACT

The present disclosure discloses a pixel circuit, an array substrate, a display device and a pixel driving method, the pixel circuit including: a driving transistor, a light emitting device, a reset sub-circuit, a light emitting control sub-circuit, a compensation sub-circuit and a data writing sub-circuit, the compensation sub-circuit acquires a threshold voltage of the driving transistor and a turn-on voltage of the light emitting device in response to control of the second control signal and the third control signal, and writes a control voltage to a gate of the driving transistor in response to the first control signal, the control voltage is equal to a sum of the threshold voltage, the data voltage and the turn-on voltage, so that the driving current outputted by the driving transistor is independent of the threshold voltage of the driving transistor, and is positively correlated with the turn-on voltage of the light emitting device.

20 Claims, 4 Drawing Sheets

(56) References Cited

U.S. PATENT DOCUMENTS

| | | | | |
|---|---|---|---|---|
| 2011/0199357 | A1* | 8/2011 | Chung | G09G 3/3233 345/211 |
| 2012/0306843 | A1* | 12/2012 | Wang | G09G 3/3258 345/212 |
| 2014/0307010 | A1* | 10/2014 | Han | G09G 3/3233 345/691 |
| 2014/0326969 | A1* | 11/2014 | Kim | H01L 27/3262 257/40 |
| 2015/0317931 | A1* | 11/2015 | Tseng | G09G 3/3233 345/78 |
| 2016/0155379 | A1* | 6/2016 | Na | G09G 3/3233 345/215 |
| 2017/0278457 | A1* | 9/2017 | Zhu | G09G 3/3233 |
| 2019/0156749 | A1* | 5/2019 | Wang | G09G 3/3233 |

* cited by examiner

PIXEL CIRCUIT, ARRAY SUBSTRATE, DISPLAY DEVICE AND PIXEL DRIVING METHOD

CROSS-REFERENCE TO RELATED APPLICATIONS

The present application claims priority to Chinese Patent Application No. 201810239996.X, filed on Mar. 22, 2018, the contents of which are incorporated herein in their entirety by reference.

BACKGROUND

The present disclosure relates to the field of display technology, and in particular, to a pixel circuit, an array substrate, a display device, and a pixel driving method.

BACKGROUND

Active Matrix Organic Light Emitting Diode (AMOLED) panel is more and more widely used. The pixel display device of the AMOLED is an Organic Light-Emitting Diode (OLED). The AMOLED can emit light by driving a thin film transistor to generate a driving current in a saturated state, and using the driving current to drive the OLED to emit light.

SUMMARY

An embodiment of the present disclosure provides a pixel circuit including: a driving transistor, a light emitting device, a reset sub-circuit, an light emitting control sub-circuit, a compensation sub-circuit, and a data writing sub-circuit, the reset sub-circuit is coupled to the data writing sub-circuit and the compensation sub-circuit at a first node, and the reset sub-circuit is configured to write a reference voltage provided by a second power terminal to the first node to reset a potential of the first node in response to control of a reset control signal;

the light emitting control sub-circuit is coupled to a first electrode of the light emitting device and the compensation sub-circuit at a second node, and the light emitting control sub-circuit is configured to write an operation voltage provided by a third power terminal to the second node in response to control of a light emitting control signal;

the data writing sub-circuit is configured to write a data voltage provided by a data line to the first node in response to control of a scanning control signal;

the compensation sub-circuit is further coupled to a second electrode of the light emitting device and a first electrode of the driving transistor at a third node, the compensation sub-circuit is further coupled to a gate of the driving transistor, the compensation sub-circuit is configured to acquire, in response to control of a second control signal, the operation voltage written to the second node by the third power terminal through the light emitting control sub-circuit, to acquire, in response to control of the second control signal and a third control signal, a threshold voltage of the driving transistor and a turn-on voltage of the light emitting device, and to write, in response to control of the first control signal, a control voltage to the gate of the driving transistor, the control voltage being equal to a sum of the threshold voltage, the data voltage and the turn-on voltage;

a second electrode of the driving transistor is coupled to the first power terminal, and the driving transistor is configured to generate a corresponding driving current under the control of the control voltage to drive the light emitting device to emit light.

In some implementations, the compensation sub-circuit includes: a first transistor, a second transistor, a third transistor and a first capacitor;

a control electrode of the first transistor is coupled to a second control signal line to receive the second control signal, a first electrode of the first transistor is coupled to a second end of the first capacitor, and a second electrode of the first transistor is coupled to the second node;

a control electrode of the second transistor is coupled to a third control signal line to receive the third control signal, a first electrode of the second transistor is coupled to the gate of the driving transistor, and a second electrode of the second transistor is coupled to the third node;

a control electrode of the third transistor is coupled to a first control signal line to receive the first control signal, and a first electrode of the third transistor is coupled to the second end of the first capacitor, a second electrode of the third transistor is coupled to the gate of the driving transistor;

a first end of the first capacitor is coupled to the first node.

In some implementations, the reset sub-circuit includes: a fourth transistor, a control electrode of the fourth transistor is coupled to a reset control signal line to receive the reset control signal, a first electrode of the fourth transistor is coupled to the second power terminal, and a second electrode of the fourth transistor is coupled to the first node.

In some implementations, the data writing sub-circuit includes: a fifth transistor, a control electrode of the fifth transistor is coupled to a scanning control signal line to receive the scan control signal, a first electrode of the fifth transistor is coupled to the data line, and a second electrode of the fifth transistor is coupled to the first node.

In some implementations, the light emitting control sub-circuit includes: a sixth transistor, a control electrode of the sixth transistor is coupled to a light emitting control signal line to receive the light emitting control signal, a first electrode of the sixth transistor is coupled to the third power terminal, and a second electrode of the sixth transistor is coupled to the second node.

In some implementations, all of the transistors in the pixel circuit are N-type thin film transistors.

An embodiment of the present disclosure further provides an array substrate, including the above pixel circuit.

An embodiment of the present disclosure further provides a display device, including the above array substrate.

An embodiment of the present disclosure further provides a pixel driving method, for driving the above pixel circuit, the pixel driving method including:

in a pre-charging stage, the reset sub-circuit writes, in response to the control of the reset control signal, the reference voltage provided by the second power terminal to the first node to reset the potential of the first node, the light emitting control sub-circuit writes, in response to the control of the light emitting control signal, the operation voltage provided by the third power terminal to the second node to pre-charge the potential of the second node, and the compensation sub-circuit acquires, in response to the control of the second control signal, the operation voltage written to the second node by the third power terminal through the light emitting control sub-circuit;

in a compensation stage, the reset sub-circuit continues to reset the potential of the first node in response to the control of the reset control signal, the light emitting control sub-circuit stops writing the operation voltage provided by the third power terminal to the second node in response to the control of the light emitting control signal, and the compensation sub-circuit acquires the threshold voltage of the driving transistor and the turn-on voltage of the light emitting device in response to the control of the second control signal and the third control signal;

in a light emitting stage, the reset sub-circuit stops writing the reference voltage provided by the second power terminal to the first node in response to the control of the reset control signal, and the light emitting control sub-circuit writing the operation voltage provided by the third power terminal to the second node again in response to the control of the light emitting control signal, the data writing sub-circuit writes the data voltage provided by the data line to the first node in response to the control of the scanning control signal, the compensation sub-circuit writes the control voltage to the gate of the driving transistor in response to the control of the first control signal, so that the driving transistor generates a corresponding driving current under the control of the control voltage to drive the light emitting device to emit light.

In some implementations, the compensation sub-circuit includes: a first transistor, a second transistor, a third transistor and a first capacitor;

a control electrode of the first transistor is coupled to a second control signal line to receive the second control signal, and a first electrode of the first transistor is coupled to a second end of the first capacitor, and a second electrode of the first transistor is coupled to the second node;

a control electrode of the second transistor is coupled to a third control signal line to receive the third control signal, a first electrode of the second transistor is coupled to the gate of the driving transistor, and a second electrode of the second transistor is coupled to the third node;

a control electrode of the third transistor is coupled to a first control signal line to receive the first control signal, and a first electrode of the third transistor is coupled to the second end of the first capacitor, a second electrode of the third transistor is coupled to the gate of the driving transistor;

a first end of the first capacitor is coupled to the first node, the pixel driving method further including:

in the compensation stage, the first transistor is turned on under the control of the second control signal provided by the second control signal line, and the second transistor is turned on under the control of the third control signal provided by the third control signal line, the third transistor is turned off under the control of the first control signal provided by the first control signal line, so that the voltage of the second node is decreased to Vth+Voled, where Vth is the threshold voltage of the driving transistor, Voled is the turn-on voltage of the light emitting device;

in the light emitting stage, the first transistor is turned off under the control of the second control signal provided by the second control signal line, the second transistor is turned off under the control of the third control signal provided by the third control signal line, and the third transistor is turned on under the control of the first control signal provided by the first control signal line.

DESCRIPTION OF EMBODIMENTS

In order to enable those skilled in the art to better understand the technical solutions of the present disclosure, a pixel circuit, an array substrate, a display device, and a pixel driving method provided by the present disclosure are described in detail below with reference to the accompanying drawings.

In the following embodiments, transistors may be independently selected from a group consisting of a polysilicon thin film transistor, an amorphous silicon thin film transistor, an oxide thin film transistor, and an organic thin film transistor. Term "control electrode" specifically refers to a gate of the transistor, term "first electrode" specifically refers to a source of the transistor, and term "second electrode" specifically refers to a drain of the transistor. Certainly, those skilled in the art should understand that the "first electrode" and the "second electrode" can be interchanged, that is, the "first electrode" specifically refers to the drain of the transistor, and the "second electrode" specifically refers to the source of the transistor.

A pixel circuit in the related art basically employs a 2T1C circuit including two thin film transistors (a switching transistor and a driving transistor) and one storage capacitor C.

However, since during the related low-temperature polysilicon process, uniformity of threshold voltages of the driving transistors on a display substrate is poor, and threshold voltages of the driving transistors may be drifted during use, so that when switching transistors are controlled, by scanning lines, to be turned on to input a same data voltage to driving transistors, different driving currents are generated in the driving transistors due to different threshold voltages of the driving transistors, resulting in poor brightness uniformity of the OLEDs in the display device.

In addition, as the using time increases, the OLED itself will generate loss, turn-on voltage of the OLED will increase, so that an actual current flowing through the OLED will decrease in a case where the driving current input to the OLED is constant, thus actual brightness of the emitted light of the OLED is lowered, and the display quality of the display device is lowered.

Figure 1:
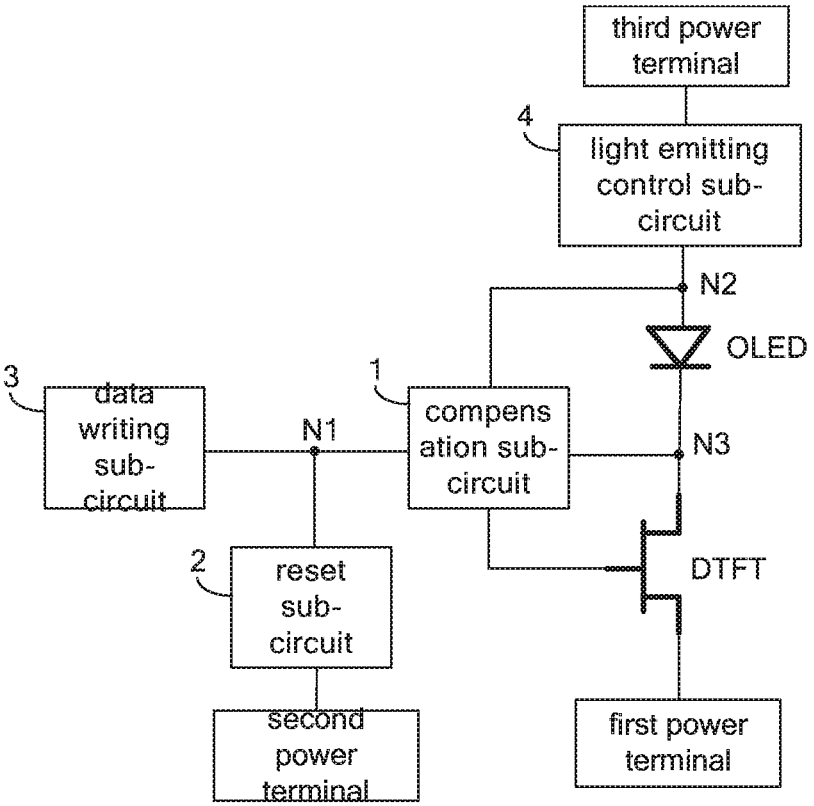
FIG. 1 is a schematic structural diagram of a pixel circuit according to an embodiment of the present disclosure.

FIG. 1 is a schematic structural diagram of a pixel circuit according to an embodiment of the present disclosure. As shown in FIG. 1, the pixel circuit includes: a driving transistor DTFT, a light emitting device OLED, a reset sub-circuit 2, a light emitting control sub-circuit 4, a compensation sub-circuit 1 and a data writing sub-circuit 3.

The reset sub-circuit 2 is coupled to the data writing sub-circuit 3 and the compensation sub-circuit 1 at a first node N1, the light-emitting control sub-circuit 4 is coupled to a first electrode of the light emitting device OLED and the compensating sub-circuit 1 at a second node N2, and the compensation sub-circuit 1 is coupled to a second electrode of the light emitting device OLED and a first electrode of the driving transistor DTFT at a third node N3.

The reset sub-circuit 2 is configured to write a reference voltage provided by a second power terminal to the first node N1 to reset the first node N1 in response to control of a reset control signal.

The light emitting control sub-circuit 4 is configured to write an operation voltage provided by a third power terminal to the second node N2 in response to control of a light emitting control signal.

The data writing sub-circuit 3 is configured to write a data voltage provided by a data line to the first node N1 in response to control of a scanning control signal.

The compensation sub-circuit 1 is also coupled to a gate of the driving transistor DTFT, and the compensation sub-circuit 1 is configured to acquire, in response to control of a second control signal, acquire the operation voltage written to the second node N2 by the third power terminal through the light emitting control sub-circuit 4, to acquire, in response to control of the second control signal and the third control signal, a threshold voltage of the driving transistor DTFT and a turn-on voltage of the light emitting device OLED, and to write, in response to control of the first control signal, a control voltage to the gate of the driving transistor DTFT in response to the control of the first control signal, and the control voltage is equal to a sum of the threshold voltage, the data voltage and the turn-on voltage.

A second electrode of the driving transistor DTFT is coupled to a first power terminal, and the driving transistor DTFT is configured to generate a corresponding driving current under the control of the control voltage to drive the light emitting device OLED to emit light.

It should be noted that the light-emitting device in the present embodiment may be a current-driven light emitting device including an LED (Light Emitting Diode) or an OLED (Organic Light Emitting Diode) in the related art. In the present embodiment, an OLED is taken as an example for description.

In the present embodiment, the first power terminal provides the reference voltage Vss (Vss is generally set to 0V); the reset sub-circuit 2 is coupled to the second power terminal, the second power terminal provides the reference voltage Vss, and the reset sub-circuit 2 writes the reference voltage Vss to the first node N to reset the first node N1; the light emitting control sub-circuit 4 is coupled to the third power terminal, and the third voltage terminal provides the operation voltage Vdd.

In a light emitting stage, a voltage applied to the gate of the driving transistor DTFT is the control voltage being Vdata+Vth+Voled, where Vdata represents the data voltage, Vth represents the threshold voltage of the driving transistor DTFT, and Voled represents the turn-on voltage of the light emitting device OLED. In this case, a gate-source voltage Vgs (a voltage difference between the gate and the source) of the driving transistor DTFT is Vdata+Vth+Voled−Vss.

According to the saturation driving current formula of the driving transistor DTFT, the following equation can be obtained:

$$\begin{aligned} I &= K*(Vgs-Vth)^2 \\ &= K*(Vdata+Vth+Voled-Vss-Vth)^2 \\ &= K*(Vdata+Voled-Vss)^2 \end{aligned}$$

where Vss is the reference voltage of 0V, then $I=K*(Voled+Vdata)^2$, where I represents a driving current output by the driving transistor DTFT; K represents a constant associated with the channel characteristics of the driving transistor DTFT.

It can be seen from the above equation that in the light emitting stage, the driving current output by the driving transistor DTFT is independent of the threshold voltage Vth of the driving transistor DTFT and the operation voltage Vdd, and is positively correlated with the turn-on voltage Voled of the light emitting device OLED.

Since the driving current I generated by the driving transistor DTFT is independent of the threshold voltage Vth of the driving transistor DTFT, the influence of the threshold voltage Vth of the driving transistor DTFT on the driving current I of the light emitting device OLED can be eliminated, and brightness uniformity of the light emitting devices OLED in the display device can be improved.

In addition, since the driving current I generated by the driving transistor DTFT is independent of the operation voltage Vdd, the influence of a voltage drop generated in a wiring for transmitting the operation voltage Vdd on the driving current I can be effectively avoided, and brightness uniformity of the light emitting devices OLED in the display device can be further improved.

At the same time, since the driving current I generated by the driving transistor DTFT is positively correlated with the turn-on voltage Voled of the light-emitting device OLED, the turn-on voltage Voled increases correspondingly as the loss of the light-emitting device OLED itself increases, and in a case where the data voltage Vdata maintains unchanged, the driving current I of the driving transistor DTFT output to the light emitting device OLED is also increased, so that lowering of the brightness of the light emitting device OLED due to the loss of the light emitting device OLED itself can be compensated.

It can be seen that the technical solution of the present disclosure can simultaneously solve the technical problem that the brightness uniformity of the light emitting device OLED in the display device is poor, and the technical problem that the light emitting device OLED has a reduced brightness due to its own loss.

Figure 2:
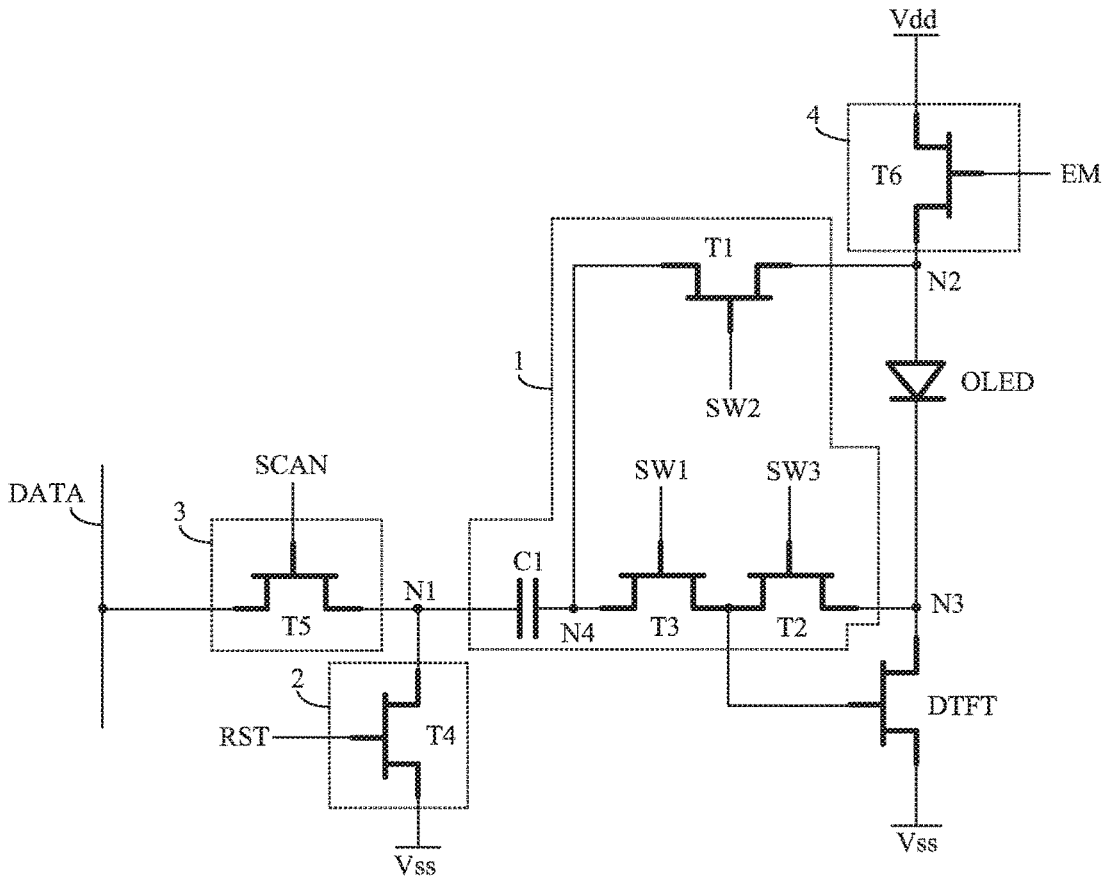
FIG. 2 is a schematic structural diagram of another pixel circuit according to an embodiment of the present disclosure.

FIG. 2 is a schematic structural diagram of a pixel circuit according to another embodiment of the present disclosure. As shown in FIG. 2, the pixel circuit is an specific implementation based on the pixel circuit shown in FIG. 1.

In some embodiments, the compensation sub-circuit 1 includes a first transistor T1, a second transistor T2, a third transistor T3 and a first capacitor C1.

A control electrode of the first transistor T1 is coupled to a second control signal line SW2 to receive a second control signal, a first electrode of the first transistor T1 is coupled to a second end of the first capacitor C1, and a second electrode of the first transistor T1 is coupled to the second node N2; a control electrode of the second transistor T2 is coupled to a third control signal line SW3 to receive the third control signal, a first electrode of the second transistor T2 is coupled to the gate of the driving transistor DTFT, and a second electrode of the second transistor T2 is coupled to the third node N3; a control electrode of the third transistor T3 is coupled to a first control signal line SW1 to receive the first control signal, and a first electrode of the third transistor T3 is coupled to a second end of the first capacitor C1, a second electrode of the third transistor T3 is coupled to the gate of the driving transistor DTFT; and a first end of the first capacitor C1 is coupled to the first node N1.

In some implementations, the reset sub-circuit 2 includes a fourth transistor T4, a control electrode of the fourth transistor T4 is coupled to a reset control signal line RST to receive the reset control signal, a first electrode of the fourth transistor T4 is coupled to the second power terminal, and a second electrode of the fourth transistor T4 is coupled to the first node N1.

In some implementations, the data writing sub-circuit 3 includes a fifth transistor T5, a control electrode of the fifth transistor T5 is coupled to a scanning control signal line SCAN to receive the scan control signal, a first electrode of the fifth transistor T5 is coupled to the data line DATA, and a second electrode of the fifth transistor T5 is coupled to the first node N1.

In some implementations, the light emitting control sub-circuit 4 includes a sixth transistor T6, a control electrode of the sixth transistor T6 is coupled to a light emitting control signal line EM to receive the light emitting control signal, a first electrode of the sixth transistor T6 is coupled to the third power terminal, and a second electrode of the sixth transistor T6 is coupled to the second node N2.

In some implementations, all of the transistors in the pixel circuit are N-type transistors, thus all of the transistors can be simultaneously fabricated by employing a same fabrication process, thereby shortening the production cycle of the pixel circuit. It should be noted that all of the transistors in the pixel circuit being N-type thin film transistors is only an exemplary implementation, which will not limit the scope of the technical solution of the present disclosure.

An operation process of the pixel circuit provided by the present embodiment will be described in detail below with reference to the accompanying drawings. Hereinafter, the description will be described by taking the driving transistor DTFT, the first transistor T1 to the sixth transistor T6 (wherein the first transistor T1 to the sixth transistor T6 are used as switching transistors) being N-type thin film transistors as an example. The first power terminal and the second power terminal each provides a reference voltage Vss (0V), and the third power terminal provides an operation voltage Vdd. The first control signal line SW1 provides the first control signal, the second control signal line SW2 provides the second control signal, the third control signal line SW3 provides the third control signal, the scanning control signal line SCAN provides the scanning control signal, the reset control signal line RST provides the reset control signal, and the light emitting control signal line EM provides the light emitting control signal.

For convenience of description, a node to which the second end of the first capacitor C1, the first electrode of the first transistor T1 and the first electrode of the third transistor T3 are coupled is referred to as a fourth node N4.

Figure 3:
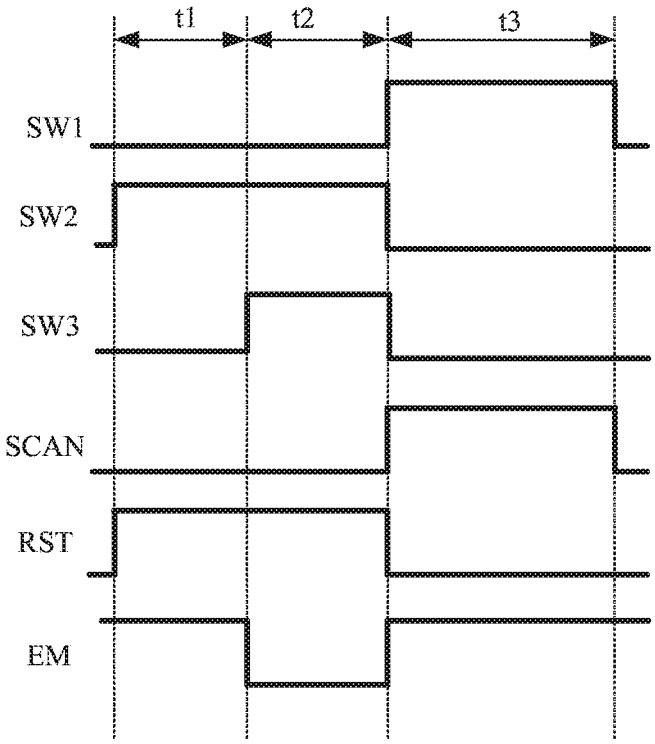
FIG. 3 is an operation timing diagram of the pixel circuit shown in FIG. 2.

FIG. 3 is an operation timing diagram of the pixel circuit shown in FIG. 2. As shown in FIG. 3, the operation process of the pixel circuit includes three stages: a pre-charging stage t1, a compensation stage t2 and a light emitting stage t3.

In the pre-charging stage t1, the first control signal provided by the first control signal line SW1 is at a low level, the second control signal provided by the second control signal line SW2 is at a high level, the third control signal provided by the third control signal line SW3 is at a low level, the scan control signal provided by the scan control signal line SCAN is at a low level, the reset control signal provided by the reset control signal line RST is at a high level, and the light emitting control signal provided by the light emitting control signal line EM is at a high level. At this time, the first transistor T1, the fourth transistor T4 and the sixth transistor T6 are all turned on, and the second transistor T2, the third transistor T3 and the fifth transistor T5 are all turned off.

Since the fourth transistor T4 is turned on, the reference voltage Vss provided by the second power terminal is written to the first node N1, so that the voltage of the first node N1 is 0V.

Since the sixth transistor T6 is turned on, the operation voltage Vdd provided by the third power terminal is written to the second node N2, so that the voltage of the second node N2 is Vdd, accordingly, the voltage of the third node N3 is Vdd-Voled. At the same time, since the first transistor T1 is turned on, the voltage of the fourth node N4 is equal to the voltage of the second node N2 which is Vdd. At this time, a voltage difference between two ends of the first capacitor C1 is Vdd, so that pre-charging of the first capacitor C1 is completed.

It should be noted that, since both the second transistor T2 and the third transistor T3 are turned off, the gate of the driving transistor DTFT is in a floating state. Therefore, in an initial period of the pre-charging stage t1, the voltage of the gate of the driving transistor DTFT is equal to a voltage of a previous stage (the light emitting stage of a previous cycle), and at this time, the driving transistor DTFT still outputs a current; in the process, the voltage of the gate of the driving transistor DTFT is reduced by rapid discharging until the voltage of the gate is equal to Vth, so that the driving transistor DTFT is turned off. In the above discharging process, although the light emitting device OLED may emit light by mistake, it cannot be recognized by eyes of a human since the discharging time is short, thus the user's experience can be ensured.

In the pre-charging stage t1, since the reference voltage Vss provided by the second power terminal can directly charge the first end (the first node N1) of the first capacitor C1, the operation voltage Vdd provided by the third power terminal can directly charge the second end of the capacitor C1 (the fourth node N4), so that the charging time can be shortened, in this case, the duration of the pre-charging stage can be designed to be short.

In the compensation stage t2, the first control signal provided by the first control signal line SW is at a low level, the second control signal provided by the second control signal line SW2 is at a high level, the third control signal provided by the third control signal line SW3 is at a high level, the scanning control signal provided by the scanning control signal line SCAN is at a low level, the reset control signal provided by the reset control signal line RST is at a high level, and the light emitting control signal provided by the light emitting control signal line EM is at a low level. At this time, the first transistor T1, the second transistor T2 and the fourth transistor T4 are all turned on, and the third transistor T3, the fifth transistor T5 and the sixth transistor T6 are all turned off.

Since the fourth transistor T4 is turned on, the voltage of the first node N1 is remaining at 0V.

Since the sixth transistor T6 is turned off, the operation voltage Vdd provided by the third power terminal no longer charges the second node N2, and the second node N2 no longer charges the third node N3. At this time, since the second transistor T2 is turned on, the control electrode of the driving transistor DTFT is at a high level, so that the driving transistor DTFT is turned on, thus the third node N3 is discharged through the driving transistor DTFT until the voltage of the third node N3 (the voltage of the gate of the driving transistor DTFT) is lowered to Vth, and the driving transistor DTFT is turned off. At this time, the voltages of the second node N2 and the fourth node N4 are both Vth+Voled (i.e., the threshold voltage of the driving transistor DTFT and the turn-on voltage of the light emitting device OLED are obtained), so that the voltage difference between the two ends of the first capacitor C1 is Vth+Voled.

It should be noted that, in the process in which the third node N3 is discharged through the driving transistor DTFT, although the light emitting device OLED may emit light by mistake, it cannot be recognized by eyes of a human since the discharging time is short, thus the user's experience can be ensured.

In the light emitting stage t3, the first control signal provided by the first control signal line SW1 is at a high level, the second control signal provided by the second control signal line SW2 is at a low level, the third control signal provided by the third control signal line SW3 is at a low level, the scanning control signal provided by the scanning control signal line SCAN is at a high level, the reset control signal provided by the reset control signal line RST is at a low level, and the light emitting control signal provided by the light emitting control signal line EM is at a high level. At this time, the third transistor T3, the fifth transistor T5 and the sixth transistor T6 are all turned on, and the first transistor T1, the second transistor T2 and the fourth transistor T4 are all turned off.

Since both the first transistor T1 and the second transistor T2 are turned off, the fourth node N4 is in a floating state. Further, since the fifth transistor T5 is turned on, the data voltage Vdata of the data line DATA is written to the first node N1 through the fifth transistor T5, at this time, the voltage of the first node N1 is jumped from 0V to Vdata. Due to the bootstrap effect of the first capacitor C1 (i.e., the voltage difference across the capacitor maintains unchanged), the voltage of the fourth node N4 is jumped from Vth+Voled to Vth+Voled+Vdata, that is, the voltage of the gate of the driving transistor DTFT is Vth+Voled+Vdata, the voltage between the gate and the source (i.e., the gate-source voltage) of the driving transistor is Vth+Voled+Vdata.

According to the saturation driving current formula of the driving transistor DTFT, the following equation can be obtained:

$$\begin{aligned} I &= K*(Vgs - Vth)^2 \\ &= K*(Vdata + Vth + Voled - Vth)^2 \\ &= K*(Vdata + Voled)^2 \end{aligned}$$

Where I represents the driving current output by the driving transistor DTFT; K represents a constant associated with the channel characteristics of the driving transistor DTFT.

It can be seen from the above equation that the driving current output by the driving transistor DTFT is independent of the threshold voltage Vth of the driving transistor DTFT and the operation voltage Vdd, and is positively correlated with the turn-on voltage Voled of the light emitting device OLED.

Since the driving current I generated by the driving transistor DTFT is independent of the threshold voltage Vth of the driving transistor DTFT, the influence of the threshold voltage Vth of the driving transistor DTFT on the driving current I of the light emitting device OLED can be eliminated, and brightness uniformity of the light emitting devices OLED in the display device can be improved.

In addition, since the driving current I generated by the driving transistor DTFT is independent of the operation voltage Vdd, the influence of the voltage drop generated by the wiring for transmitting the operation voltage Vdd on the driving current I can be effectively avoided, and brightness uniformity of the light emitting devices OLED in the display device can be further improved.

At the same time, since the driving current I generated by the driving transistor DTFT is positively correlated with the turn-on voltage Voled of the light-emitting device OLED, the turn-on voltage Voled increases correspondingly as the loss of the light-emitting device OLED itself increases, and in a case where the data voltage Vdata maintains unchanged, the driving current I of the driving transistor DTFT output to the light emitting device OLED is also increased, so that lowering of the brightness of the light emitting device OLED due to the loss of the light emitting device OLED itself can be compensated.

Figure 4:
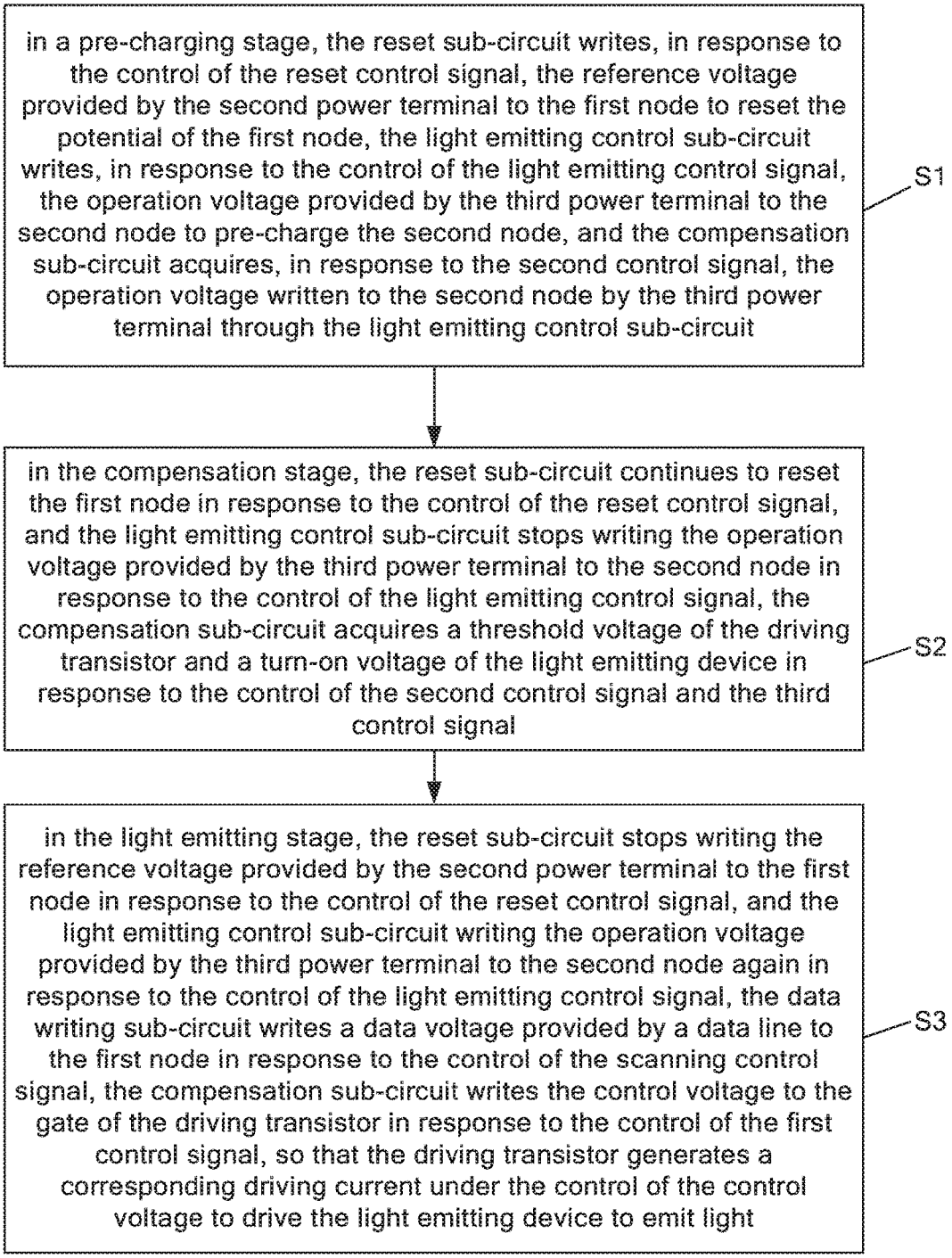
FIG. 4 is a flowchart of a pixel driving method according to an embodiment of the present disclosure.

FIG. 4 is a flowchart of a pixel driving method according to an embodiment of the present disclosure. As shown in FIG. 4, the pixel driving method is based on the pixel circuit provided by the foregoing embodiments, and the pixel driving method includes the following steps.

At step S1, in a pre-charging stage, the reset sub-circuit writes, in response to the control of the reset control signal, the reference voltage provided by the second power terminal to the first node to reset the potential of the first node, the light emitting control sub-circuit writes, in response to the control of the light emitting control signal, the operation voltage provided by the third power terminal to the second node to pre-charge the potential of the second node, and the compensation sub-circuit acquires, in response to the control of the second control signal, the operation voltage written to the second node by the third power terminal through the light emitting control sub-circuit.

At step S2, in a compensation stage, the reset sub-circuit continues to reset the potential of the first node in response to the control of the reset control signal, the light emitting control sub-circuit stops writing the operation voltage provided by the third power terminal to the second node in response to the control of the light emitting control signal, and the compensation sub-circuit acquires a threshold voltage of the driving transistor and a turn-on voltage of the light emitting device in response to the control of the second control signal and the third control signal.

In a case where the compensation sub-circuit includes the first transistor to the third transistor and the first capacitor, in the compensation stage, the first transistor is turned on under the control of the second control signal provided by the second control signal line, the second transistor is turned on under the control of the third control signal provided by the third control signal line, and the third transistor is turned off under the control of the first control signal provided by the first control signal line, so that the voltage of the second node is lowered to Vth+Voled, where Vth is the threshold voltage of the driving transistor and Voled is the turn-on voltage of the light emitting device.

At step S3, in the light emitting stage, the reset sub-circuit stops writing the reference voltage provided by the second power terminal to the first node in response to the control of the reset control signal, the light emitting control sub-circuit writing the operation voltage provided by the third power terminal to the second node again in response to the control of the light emitting control signal, the data writing sub-circuit writes a data voltage provided by a data line to the first node in response to the control of the scanning control signal, and the compensation sub-circuit writes a control voltage to the gate of the driving transistor in response to the control of the first control signal, so that the driving transistor generates a corresponding driving current under the control of the control voltage to drive the light emitting device to emit light.

The control voltage is equal to a sum of the threshold voltage, the data voltage and the turn-on voltage.

In the light emitting stage, the first transistor is turned off under the control of the second control signal provided by the second control signal line, the second transistor is turned off under the control of the third control signal provided by the third control signal line, and the third transistor is turned on under the control of the first control signal provided by the first control signal line.

For the detailed description of the foregoing steps S1 to S3, the corresponding content in the foregoing embodiment may be referred to, and details thereof are not described herein again.

An embodiment of the present disclosure provides a pixel driving method, wherein the threshold voltage of the driving transistor and the turn-on voltage of a light emitting device are acquired by using the compensation sub-circuit in the compensation stage, and writing the control voltage which is equal to a sum of the data voltage, the threshold voltage of the driving transistor and the turn-on voltage of the light emitting device to the gate of the driving transistor, so that the driving current output by the driving transistor is independent of the threshold voltage of the driving transistor and the operation voltage, and is positively correlated with the turn-on voltage of the light emitting device, therefore, the brightness uniformity of the light-emitting devices in the display device can be improved, and lowering of the brightness of the light emitting device due to the loss of light emitting device itself can be compensated.

It can be seen that the technical solution of the present embodiment can simultaneously solve the technical problem that the brightness uniformity of the light-emitting devices in the display device is poor, and the technical problem that the brightness of each light-emitting device is reduced due to the loss of light emitting device itself.

An embodiment of the present disclosure provides an array substrate, which includes: a pixel circuit, which is the pixel circuit provided in the above embodiment.

For details, the contents in the foregoing embodiment may be referred, and details thereof are not described herein again.

An embodiment of the present disclosure provides a display device which includes an array substrate. The array substrate is the array substrate of the above embodiment. For details, the contents in the above embodiments may be referred, and details are not described herein.

It should be understood that, the foregoing embodiments are only exemplary embodiments used for explaining the principle of the present disclosure, but the present disclosure is not limited thereto. Various variations and improvements may be made by a person skilled in the art without departing from the spirit and essence of the present disclosure, and these variations and improvements also fall into the protection scope of the present disclosure.

The invention claimed is:

1. A pixel circuit comprising: a driving transistor, a light emitting device, a reset sub-circuit, an light emitting control sub-circuit, a compensation sub-circuit, and a data writing sub-circuit, wherein the reset sub-circuit is coupled to the data writing sub-circuit and the compensation sub-circuit at a first node, and the reset sub-circuit is configured to write a reference voltage provided by a second power terminal to the first node to reset a potential of the first node in response to control of a reset control signal;

the light emitting control sub-circuit is coupled to a first electrode of the light emitting device and the compensation sub-circuit at a second node, and the light emitting control sub-circuit is configured to write an operation voltage provided by a third power terminal to the second node in response to control of a light emitting control signal;

the data writing sub-circuit is configured to write a data voltage provided by a data line to the first node in response to control of a scanning control signal;

the compensation sub-circuit is further coupled to a second electrode of the light emitting device and a first electrode of the driving transistor at a third node, the compensation sub-circuit is further coupled to a gate of the driving transistor, the compensation sub-circuit is configured to acquire, in response to control of a second control signal, the operation voltage written to the second node by the third power terminal through the light emitting control sub-circuit, to acquire, in response to control of the second control signal and a third control signal, a threshold voltage of the driving transistor and a turn-on voltage of the light emitting device, and to write, in response to control of a first control signal, a control voltage to the gate of the driving transistor, the control voltage being equal to a sum of the threshold voltage, the data voltage and the turn-on voltage;

a second electrode of the driving transistor is coupled to the first power terminal, and the driving transistor is configured to generate a corresponding driving current under the control of the control voltage to drive the light emitting device to emit light.

2. The pixel circuit of claim 1, wherein the compensation sub-circuit comprises: a first transistor, a second transistor, a third transistor and a first capacitor;

a control electrode of the first transistor is coupled to a second control signal line to receive the second control signal, a first electrode of the first transistor is coupled to a second end of the first capacitor, and a second electrode of the first transistor is coupled to the second node;

a control electrode of the second transistor is coupled to a third control signal line to receive the third control signal, a first electrode of the second transistor is coupled to the gate of the driving transistor, and a second electrode of the second transistor is coupled to the third node;

a control electrode of the third transistor is coupled to a first control signal line to receive the first control signal, a first electrode of the third transistor is coupled to the second end of the first capacitor, and a second electrode of the third transistor is coupled to the gate of the driving transistor;

a first end of the first capacitor is coupled to the first node.

3. The pixel circuit of claim 1, wherein the reset sub-circuit comprises: a fourth transistor, a control electrode of the fourth transistor is coupled to a reset control signal line to receive the reset control signal, a first electrode of the fourth transistor is coupled to the second power terminal, and a second electrode of the fourth transistor is coupled to the first node.

4. The pixel circuit of claim 2, wherein the reset sub-circuit comprises: a fourth transistor, a control electrode of the fourth transistor is coupled to a reset control signal line to receive the reset control signal, a first electrode of the fourth transistor is coupled to the second power terminal, and a second electrode of the fourth transistor is coupled to the first node.

5. The pixel circuit of claim 1, wherein the data writing sub-circuit comprises: a fifth transistor, a control electrode of the fifth transistor is coupled to a scanning control signal line to receive the scan control signal, a first electrode of the fifth transistor is coupled to the data line, and a second electrode of the fifth transistor is coupled to the first node.

6. The pixel circuit of claim 2, wherein the data writing sub-circuit comprises: a fifth transistor, a control electrode of the fifth transistor is coupled to a scanning control signal line to receive the scan control signal, a first electrode of the fifth transistor is coupled to the data line, and a second electrode of the fifth transistor is coupled to the first node.

7. The pixel circuit of claim 3, wherein the data writing sub-circuit comprises: a fifth transistor, a control electrode of the fifth transistor is coupled to a scanning control signal line to receive the scan control signal, a first electrode of the fifth transistor is coupled to the data line, and a second electrode of the fifth transistor is coupled to the first node.

8. The pixel circuit of claim 4, wherein the data writing sub-circuit comprises: a fifth transistor, a control electrode of the fifth transistor is coupled to a scanning control signal line to receive the scan control signal, a first electrode of the fifth transistor is coupled to the data line, and a second electrode of the fifth transistor is coupled to the first node.

9. The pixel circuit of claim 1, wherein the light emitting control sub-circuit comprises: a sixth transistor, a control electrode of the sixth transistor is coupled to a light emitting control signal line to receive the light emitting control signal, a first electrode of the sixth transistor is coupled to the third power terminal, and a second electrode of the sixth transistor is coupled to the second node.

10. The pixel circuit of claim 2, wherein the light emitting control sub-circuit comprises: a sixth transistor, a control electrode of the sixth transistor is coupled to a light emitting control signal line to receive the light emitting control signal, a first electrode of the sixth transistor is coupled to the third power terminal, and a second electrode of the sixth transistor is coupled to the second node.

11. The pixel circuit of claim 3, wherein the light emitting control sub-circuit comprises: a sixth transistor, a control electrode of the sixth transistor is coupled to a light emitting control signal line to receive the light emitting control signal, a first electrode of the sixth transistor is coupled to the third power terminal, and a second electrode of the sixth transistor is coupled to the second node.

12. The pixel circuit of claim 4, wherein the light emitting control sub-circuit comprises: a sixth transistor, a control electrode of the sixth transistor is coupled to a light emitting control signal line to receive the light emitting control signal, a first electrode of the sixth transistor is coupled to the third power terminal, and a second electrode of the sixth transistor is coupled to the second node.

13. The pixel circuit of claim 5, wherein the light emitting control sub-circuit comprises: a sixth transistor, a control electrode of the sixth transistor is coupled to a light emitting control signal line to receive the light emitting control signal, a first electrode of the sixth transistor is coupled to the third power terminal, and a second electrode of the sixth transistor is coupled to the second node.

14. The pixel circuit of claim 8, wherein the light emitting control sub-circuit comprises: a sixth transistor, a control electrode of the sixth transistor is coupled to a light emitting control signal line to receive the light emitting control signal, a first electrode of the sixth transistor is coupled to the third power terminal, and a second electrode of the sixth transistor is coupled to the second node.

15. The pixel circuit of claim 14, wherein all of the transistors in the pixel circuit are N-type thin film transistors.

16. An array substrate, comprising a pixel circuit, wherein the pixel circuit is the pixel circuit of claim 1.

17. An array substrate, comprising a pixel circuit, wherein the pixel circuit is the pixel circuit of claim 15.

18. A display device, comprising an array substrate, wherein the array substrate is the array substrate of claim 16.

19. A pixel driving method, for driving the pixel circuit of claim 1, the pixel driving method comprising:

in a pre-charging stage, the reset sub-circuit writes, in response to the control of the reset control signal, the reference voltage provided by the second power terminal to the first node to reset the potential of the first node, the light emitting control sub-circuit writes, in response to the control of the light emitting control signal, the operation voltage provided by the third power terminal to the second node to pre-charge the potential of the second node, and the compensation sub-circuit acquires, in response to the control of the second control signal, the operation voltage written to the second node by the third power terminal through the light emitting control sub-circuit;

in a compensation stage, the reset sub-circuit continues to reset the potential of the first node in response to the control of the reset control signal, the light emitting control sub-circuit stops writing the operation voltage provided by the third power terminal to the second node in response to the control of the light emitting control signal, and the compensation sub-circuit acquires the threshold voltage of the driving transistor and the turn-on voltage of the light emitting device in response to the control of the second control signal and the third control signal;

in a light emitting stage, the reset sub-circuit stops writing the reference voltage provided by the second power terminal to the first node in response to the control of the reset control signal, the light emitting control sub-circuit writing the operation voltage provided by the third power terminal to the second node again in response to the control of the light emitting control signal, the data writing sub-circuit writes the data voltage provided by the data line to the first node in response to the control of the scanning control signal, and the compensation sub-circuit writes the control voltage to the gate of the driving transistor in response to the control of the first control signal, so that the driving transistor generates a corresponding driving current under the control of the control voltage to drive the light emitting device to emit light.

20. The pixel driving method of claim 19, wherein the compensation sub-circuit comprises: a first transistor, a second transistor, a third transistor and a first capacitor;

a control electrode of the first transistor is coupled to a second control signal line to receive the second control signal, and a first electrode of the first transistor is coupled to a second end of the first capacitor, and a second electrode of the first transistor is coupled to the second node;

a control electrode of the second transistor is coupled to a third control signal line to receive the third control signal, a first electrode of the second transistor is coupled to the gate of the driving transistor, and a second electrode of the second transistor is coupled to the third node;

a control electrode of the third transistor is coupled to a first control signal line to receive the first control signal, and a first electrode of the third transistor is coupled to the second end of the first capacitor, a second electrode of the third transistor is coupled to the gate of the driving transistor;

a first end of the first capacitor is coupled to the first node, the pixel driving method further comprising:

in the compensation stage, the first transistor is turned on under the control of the second control signal provided by the second control signal line, and the second transistor is turned on under the control of the third control signal provided by the third control signal line, the third transistor is turned off under the control of the first control signal provided by the first control signal line, so that the voltage of the second node is decreased to Vth+Voled, where Vth is the threshold voltage of the driving transistor, Voled is the turn-on voltage of the light emitting device;

in the light emitting stage, the first transistor is turned off under the control of the second control signal provided by the second control signal line, the second transistor is turned off under the control of the third control signal provided by the third control signal line, and the third transistor is turned on under the control of the first control signal provided by the first control signal line.

* * * * *